United States Patent [19]

Cuzzone

[11] 4,156,225

[45] May 22, 1979

[54] ELECTRIC FUSE WITH INDICATING MEANS

[75] Inventor: Raymond Cuzzone, Hickory, N.C.

[73] Assignee: General Electric Company, Philadelphia, Pa.

[21] Appl. No.: 870,708

[22] Filed: Jan. 19, 1978

[51] Int. Cl.[2] ..... H01H 85/30

[52] U.S. Cl. ..... 337/244; 337/241

[58] Field of Search ..... 337/244, 241, 245, 267, 337/265; 116/114.5; 340/638

[56] References Cited

U.S. PATENT DOCUMENTS

| | | | |
|---|---|---|---|
| 2,343,224 | 2/1944 | Powell | 337/244 |
| 2,421,658 | 3/1947 | Strang et al. | 337/244 |
| 4,060,786 | 11/1977 | Cuzzone | 337/244 |

FOREIGN PATENT DOCUMENTS

| | | | |
|---|---|---|---|
| 1463655 | 3/1969 | Fed. Rep. of Germany | 337/244 |

*Primary Examiner*—J. D. Miller
*Assistant Examiner*—J. Moy
*Attorney, Agent, or Firm*—William Freedman; Carl L. Silverman

[57] ABSTRACT

An electric fuse is of the type including indicating means for indicating if the main fusible element has melted. The indicating means includes a first and second auxiliary fusible element, each having a higher resistance than the main fusible element. When the fuse is fully assembled, and the main fusible element has melted, the path of current is through the first and second auxiliary fusible elements. The second auxiliary fusible element functions to restrain movement of an indicator button. When current flows through the auxiliary fusible elements, the second auxiliary fusible element is designed to melt first, thereby causing the indicator button to move. The operability of the first and second auxiliary fusible elements can be independently and non-destructively determined before and after assembly of the fuse. After fuse assembly, the fuse can be non-destructively disassembled so as to determine the operability of the first and second auxiliary elements. Then, if the auxiliary elements are operable, the fuse can be simply reassembled.

8 Claims, 2 Drawing Figures

ELECTRIC FUSE WITH INDICATING MEANS

BACKGROUND OF THE INVENTION

This invention relates to an electric fuse, and more particularly to such a fuse with indicating means which can be non-destructively tested.

Current limiting power fuses generally have a cylindrical housing of insulating material which is closed at each end by a metal terminal cap. A main fusible element(s), usually a silver ribbon, extends inside the housing between the terminal caps. The space around the fuse element is filled with silica sand. When current through the fuse exceeds the rating of the fuse for a sufficient time, the element melts, or fuses at one or more points, causing the formation of an arc. The arc progressively melts the sand and forms channels of fulgurite in it. The relatively high resistance fulgurite eventually suppresses any significant flow of current through the fuse.

The melting of the main fusible element is generally silient, and hence, not noticeable. Thus, it is common to provide indicating means by which it can be readily determined if the main fusible element has melted. Such indicating means generally comprises a high resistance auxiliary fusible element, of a material such as the one available under the trademark Nichrome, disposed between the terminal caps, and in parallel electrical relation with the main fusible element. A portion of the auxiliary element is placed under tension and connected to an indicating means assembly which includes a movable indicator. In operation of such a fuse, when the main element melts, current is diverted through the auxiliary element. This results in the melting of the auxiliary element and movement of the indicator. Exemplary movable indicator mechanisms are described in U.S. Pat. No. 3,895,338 issued July 15, 1975 to Gray et al, and assigned to the assignee of the present application, and in U.S. Pat. No. 2,797,279, issued June 25, 1957 to Brandt et al.

Although such fuses are successful for many applications, there are some problems associated with their use and assembly. One such problem is that, after assembly of the fuse and indicating means, there is no means for nondestructively determining if the indicating means has been properly assembled, and hence, in operable condition. More particularly, the auxiliary fusible element is permanently attached in parallel with the main fusible element. The main fusible element is of much lower resistance than the auxiliary fusible element so that it is difficult to determine if the auxiliary fusible element is operable by measuring the fuse resistance between the terminal caps. This is due to the fact that the resistance of the auxiliary fusible element adds very little to the total fuse resistance. This causes it to be virtually impossible to detect a resistance difference which would indicate whether or not the auxiliary fusible element is in operable condition. One proposed solution to this problem is to X-ray the fuse so as to determine the condition of the auxiliary fusible element. However, it has been found that the generally heavy copper ferrules and end caps mask out the area at the ends of the fuse so that the auxiliary element cannot be observed in those areas. Also, this procedure requires the use of sophisticated equipment not generally available to common users of such fuses.

Accordingly, it is a general object of my invention to provide an electric fuse assembly with indicating means in which the operability of the indicating means can be reliably determined.

It is another object of my invention to provide such an electric fuse in which the indicating means includes an auxiliary fusible element whose resistance can be nondestructively and independently tested.

SUMMARY OF THE INVENTION

In carrying out one form of my invention, I provide an electric fuse having an insulating housing and conductive terminal caps disposed at opposing ends of the housing. At least one main fusible element is disposed inside the housing and electrically connects the terminal caps. Indicating means for indicating when the main fusible element has melted is provided. The indicating means includes at least one auxiliary fusible element disposed inside the housing between the terminal caps but electrically insulated from at least one of the terminal caps. The auxiliary fusible element has a greater resistance than the main fusible element. The indicating means also includes a detachable indicating means assembly adapted to be secured to the one terminal cap. The detachable indicating means assembly includes a pair of spaced opposing contact portions with means biasing the contact portions away from each other. A second auxiliary fusible element is disposed between and electrically connects the contact portions. The contact portions are disposed such that, when the indicating means assembly is secured to the one terminal cap, one of the contact portions is in fixed relation and electrically engages the first auxiliary fusible element at the one terminal cap and is electrically connected to the one terminal cap only through the second fusible element, and the other contact portion electrically engages the one terminal cap. The presence of the second auxiliary fusible elements prevents the biasing means from moving the other contact portion away from the fixed contact portion.

BRIEF DESCRIPTION OF THE DRAWINGS

My invention will be more fully understood and its several objects and advantages further appreciated by referring now to the following description, taken in conjunction with the accompanying drawings, wherein.

DETAILED DESCRIPTION OF THE INVENTION

Figure 1:
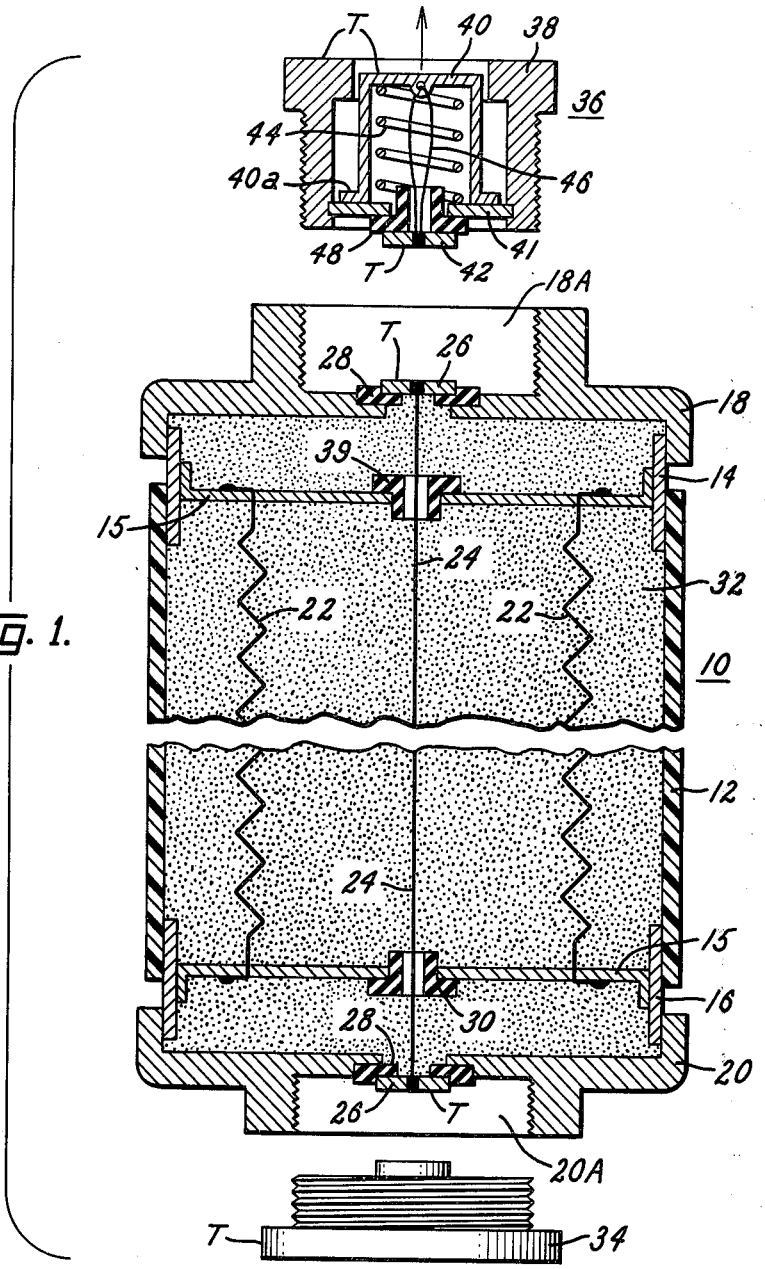
FIG. 1 is a partially cut away exploded sectional view of one form of electric fuse of the present invention showing the fuse prior to final assembly thereof.

Referring initially to FIG. 1, one form of electric fuse of the present invention is generally designated 10. The fuse 10 includes a housing 12 of insulating material, such as fiberglass. The housing 12 includes an upper conductive ferrule 14 at one end and a lower conductive ferrule 16 at the other end. The ferrules 14 and 16 are welded to element supports 15. The end openings of the upper and lower ferrules 14 and 16 are closed by upper and lower conductive end terminal caps 18, 20, respectively. Two fusible ribbon conductors 22, of a material such as silver, comprise the main fusible element.

Also disposed within the housing 12 is an auxiliary fusible element 24, which is chosen to be of a material, e.g., Nichrome, such that the fusible element 24 has a higher resistance than the fusible element 22. The auxiliary fusible element 24 is in fixed relation between the end terminal caps 18 and 20 but is electrically insulated from the terminal caps by insulating washers 28. Similarly, the auxiliary fusible element 24 is electrically insulated from the element supports 15 of the conductive ferrules 14 and 16 by insulating bushings 30. The ends of the fusible element 24 are connected to contact portions 26, which may comprise brass washers. The space around the main fusible element 22 and auxiliary fusible element 24 is substantially filled with an interrupting medium such as finely divided sand 32.

The lower end terminal cap 20 includes a portion 20A which is of a configuration adapted to receive a matching conductive plug 34. As shown, the plug 34 includes external threads adapted to engage internal threads in the portion 20A of the terminal cap 20. Referring now to the upper terminal end cap 18, a portion 18A of the terminal cap 18 is adapted to receive an indicating means assembly 36. More particularly, the terminal end cap 18 includes internal threads for receiving matching external threads of the indicating means assembly 36.

Referring more particularly to the indicating means assembly 36, its features will now be described. The indicating means assembly 36 includes a conductive housing 38, of a material such as brass, which is of a configuration such that the matching external threads thereon permit it to be securely, and detachably, fixed to the end terminal cap 18. Within the conductive housing 38 is a movable conductive striker button 40, i.e., indicator button, of a material such as brass, and of generally bell shaped configuration. The conductive striker button 40 includes flared end portions **40*a* which rest on, and electrically contact a conductive washer 41, which is in fixed electrical contact with the conductive housing 38. A second auxiliary fusible element 46 is disposed between, and connects, an upper contact portion of the movable brass striker button 40 and a fixed position lower contact portion 42 of the brass indicating means assembly 36. The fixed position lower contact portion 42 is electrically separated from the conductive washer 41 by an insulating bushing 48. Hence, the lower contact portion 42 is electrically insulated from the conductive housing 38. A spring 44 is disposed between the movable upper and fixed lower contact portions of the brass indicating means assembly 36. The spring 44 operates to bias the movable upper contact portion away from the fixed lower contact portion 42. However, the presence of the second auxiliary fusible element 46 prevents the spring 44 from moving the movable upper contact portion away from the fixed lower contact portion 42. It is preferable to double the second auxiliary element 46, as shown in FIG. 1, in order to provide sufficient strength to oppose the spring 44. For reasons to be discussed later, it is also preferable that no sand be provided around the auxiliary fusible element 46**.

In order to fully assembly the fuse 10 into operable form, it is only necessary to physically and electrically secure the lower conductive plug 34 to the end terminal cap 20 and the indicating means assembly 36 to the terminal end cap 18. However, prior to such assembly, the fuse 10 of the present invention allows one to nondestructively and independently determine whether or not the auxiliary fusible elements 24 and 46 are in operable condition. More particularly, referring to the auxiliary fusible element 24, it can be seen that the end portions of the element are accessible for testing purposes. For convenience of description, tests points, hereinafter designated T, are employed. Thus, it can be seen that the contact portions 26 provide an operator with simple test points (T) to determine the resistance, and hence, the condition of the auxiliary fusible element 24. Note that, the insulating washers 28 and bushings 30 allow the operator to determine the resistance of the auxiliary fusible element 24 without the presence of the main fusible element 22. After the fusible element 24 has been determined to be in operable condition, the brass plug 34 can then be secured to the terminal cap 20.

Referring now to the indicating means assembly 36, it can be seen that the condition of the second auxiliary fusible element 46 can be similarly independently and nondestructively determined. More particularly, the condition of the second fusible element 46 can be determined by measuring the resistance between the upper contact portion of the striker button 40 and the fixed lower contact portion 42. Alternatively, other portions of the conductive striker button 40, or the conductive housing 38, may be employed in place of the upper contact portion of the striker button 40. After the second auxiliary fusible element 46 has been determined to be in operable condition, the indicating means assembly 36 can then be electrically and physically secured to the end terminal cap 18. It is to be appreciated that, when the indicating means assembly 36 is so secured, the lower fixed contact portion 42 of the assembly 36 electrically engages the top contact portion 26 at the terminal end cap 18. In this condition, the auxiliary fusible element 24 and the auxiliary fusible element 46 comprise a single high resistance path which is electrically connected between the terminal end caps 18 and 20 and in parallel electrical relation with the main fusible element 22.

The operation of the fully assembled fuse 10 of the present invention is substantially the same as that of previous fuses having such indicating means, with several important advantages. That is, when fully assembled, after the main fusible element 22 melts, the current path between the terminal caps 18 and 20 is through the first auxiliary fusible element 24 and second fusible element 46. As no interrupting medium surrounds the second auxiliary fusible element 46 of the assembly 36, under high current conditions, the second auxiliary fusible element 46 melts prior to the melting of the first auxiliary fusible element 24. This occurs because the interrupting medium cools the first auxiliary fusible element 24. When the second auxiliary fusible element melts, the movable contact portion and button 40 is moved upward in the direction of the arrow. This movement indicates that the main fusible element 22 has melted. In addition to providing such desirable operation, as previously discussed, the indicating means of the fuse 10 of the present invention can be simply and nondestructively tested. This allows the fuse 10 to be tested during and after fuse assembly, as well as for servicing purposes during usage of the fuse. For example, after fuse assembly, the detachable assembly 36 can be removed, revealing the appropriate test points (T). Then, the fuse can be simply reassembled.

It is to be appreciated that, although the first auxiliary fusible element 24 has been described with the end portion contacts 26 being electrically insulated from both terminal end caps 18 and 20, this is not always required. For example, in the fuse 10 of FIG. 1, the bottom conductive plug 34 could be removed. In such a situation, the bottom end of the fusible element 24 could be directly connected to the lower ferrule 16, or to the terminal cap 20. Such a structure would still permit the first auxiliary fusible element 24 to be independently and non-destructively tested through the use of the appropriate test points (T).

Figure 2:
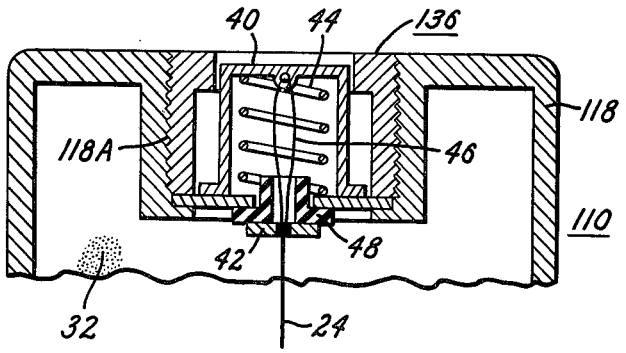
FIG. 2 is a sectional view of a portion of another form of electric fuse of the present invention.

Referring now to FIG. 2, a portion of another form of fuse of the present invention is shown and is generally designated 110. In this form of electric fuse of the present invention, the end terminal cap 118 which is adapted to receive the indicating means assembly 136 is of modified form. More particularly, the end terminal cap 118 includes a well shaped portion 118A for receiving the indicating means assembly 136.

Although two preferred embodiments have been described hereinbefore, variations are available. For example, the main fusible element(s) may comprise a single fusible element or multiple fusible elements. Similarly, the auxiliary fusible element(s) may comprise single or multiple elements. Also, the particular material(s) employed as fusible elements and fillers may be varied in accordance with the users requirements.

It is also to be appreciated that, depending upon the fuse application, the striker assembly may or may not be of the type which not only indicates fuse operation, but also operates to trigger a circuit breaker. Also, the striker button hereinbefore described need not be entirely of conductive material as long as a suitable electrical path is provided across the auxiliary fusible element which holds the striker button in fixed position in relation to the biasing means.

While I have illustrated preferred embodiments of my invention, many modifications will occur to those skilled in the art and I therefore wish to have it understood that I intend in the appended claims to cover all such modifications as fall within the true spirt and scope of my invention.

What I claim as new and desire to secure by Letters Patent of the United States is:

1. An electric fuse, which comprises:

(a) an insulating housing;

(b) a conductive terminal cap at opposing ends of said insulating housing;

(c) at least one main fusible element disposed inside said housing and electrically connecting said terminal caps; and (d) indicating means for indicating when said main fusible element has melted, said means including:

(d1) at least one auxiliary fusible element disposed inside said housing between said terminal caps but electrically insulated from at least one of said terminal caps, said auxiliary fusible element having a greater resistance than said main fusible element; and (d2) detachable indicating means assembly adapted to be secured to said one terminal cap, said detachable assembly including a pair of spaced opposing contact portions with means biasing said portions away from each other, a second auxiliary fusible element disposed between and electrically connecting said contact portions, said contact portions being disposed such that when said assembly is secured to said one terminal cap, one of said contact portions is in fixed position and electrically engages said first auxiliary fusible element at said one terminal cap and is electrically connected to said one terminal cap only through the second fusible element and the other contact portion electrically engages said one terminal cap, the presence of said second auxiliary fusible element preventing said biasing means from moving said other contact portion away from said fixed contact portion.

2. A fuse in accordance with claim 1 in which said main fusible element and said one auxiliary fusible element are surrounded by an interrupting medium.

3. A fuse in accordance with claim 1 in which said indicating means assembly and said one terminal cap include matching threads for detachably securing said indicating means assembly to said one terminal cap.

4. A fuse in accordance with claim 1 in which said indicating means assembly includes a movable conductive indicator button and a portion of said button comprises said other contact portion.

5. An electric fuse apparatus, which comprises:

(a) a main fuse portion including:

(a1) an insulating housing;

(a2) conductive terminal caps at opposing ends of said housing;

(a3) at least one main fusible element disposed between and electrically connecting and terminal caps;

(a4) at least one auxiliary fusible element disposed inside said housing between said terminal caps but electrically insulated from at least one of said caps, said auxiliary fusible element having a greater resistance than said main fusible element, said auxiliary fusible element being accessible for independent and non-destructive testing thereof;

(a5) means for securely receiving an indicating means assembly at said one terminal cap; and (b) indicating means assembly for indicating when said main element has melted comprising a pair of spaced opposing contact portions with a second auxiliary fusible element disposed therebetween, said second auxiliary fusible element being accessible for independent and non-destructive testing thereof when said assembly is not secured to said one terminal cap, said contact portions being disposed such that when said indicating means assembly is secured to said one terminal cap, one of said contact portions is in fixed position and electrically engages said first auxiliary fusible element at said one terminal cap and is electrically connected to said one terminal cap only through said second fusible element and the other contact portion electrically engages said one terminal cap, the presence of said second auxiliary fusible element preventing said biasing means from moving said other contact portion away from said fixed contact portion.

6. A fuse in accordance with claim 5 in which said main fusible element and said one auxiliary fusible element are surrounded by an interrupting medium.

7. A fuse in accordance with claim 5 in which said indicating means assembly and said one terminal cap include matching threads for detachably securing said indicating means assembly to said one terminal cap.

8. A fuse in accordance with claim 5 in which said indicating means assembly includes a movable conductive indicator button and a portion of said button comprises said other contact portion.

* * * * *